US005749415A

United States Patent [19]

Dinh

[11] Patent Number: 5,749,415

[45] Date of Patent: May 12, 1998

[54] ROOF CURB ASSEMBLY WITH INTEGRAL DEHUMIDIFIER HEAT PIPE CONTROLLED BY A BYPASS SYSTEM

[75] Inventor: Khanh Dinh, Gainesville, Fla.

[73] Assignees: Heat Pipe Technology, Inc., Alacnua; Tropic-Kool Engineering Corp., Largo, both of Fla.

[21] Appl. No.: 802,117

[22] Filed: Feb. 19, 1997

[51] Int. Cl.[6] ..... G05D 23/00

[52] U.S. Cl. ..... 165/297; 165/103; 165/104.21; 454/236; 62/186

[58] Field of Search ..... 62/404, 407, 177, 62/186, 332, 335, DIG. 16; 454/236; 165/272, 297, 104.21, 103, 104.14

[56] References Cited

U.S. PATENT DOCUMENTS

| | | | |
|---|---|---|---|
| 3,621,906 | 11/1971 | Leffert | 165/272 |
| 4,183,399 | 1/1980 | Seehausen | 165/103 |
| 4,403,481 | 9/1983 | Yoho, Sr. | 62/259.1 |
| 4,607,498 | 8/1986 | Dinh | 62/185 |
| 5,333,470 | 8/1994 | Dinh | 62/333 |

OTHER PUBLICATIONS

Roy Johannesen and Michael West, *Efficient Humidity Control with Heat Pipes*, pp. 1–8, Mar., 1992.

Gary D. Cook and Michael K. West, *Humidity: Problems, Passive and Active Control Strategies.*

Tropic–Kool Engineering Combination Roof Mounting Curb and Plenum—single sheet informational flyer.

*Primary Examiner*—John M. Sollecto

*Attorney, Agent, or Firm*—Nilles & Nilles, S.C.

[57] ABSTRACT

A bypass system is incorporated into a roof curb to permit selective partial or complete deactivation of at least one section of a heat pipe of an air conditioning system thereby 1) to permit optimization of the sensible heat ratio of the air conditioning system for prevailing environmental conditions and, 2) to prevent moisture from condensing onto the evaporator or cooling section of the heat pipe and subsequently dripping into the return ducts of the air conditioning system. The bypass system is characterized by a bypass duct located adjacent one of the sections of the heat pipe and a bypass device which selectively channels at least some of the air which would otherwise flow through the controlled section of the heat pipe through the bypass duct instead. In its simplest form, the bypass device may comprise a single damper or the like positioned within the bypass duct. In more sophisticated systems, the bypass device may be located at least in part within the bypass duct and in part within the controlled section of the heat pipe and may comprise, for example, a pair of interconnected dampers or a sliding plate.

15 Claims, 2 Drawing Sheets

ROOF CURB ASSEMBLY WITH INTEGRAL DEHUMIDIFIER HEAT PIPE CONTROLLED BY A BYPASS SYSTEM

BACKGROUND OF THE INVENTION

1. Field of the Invention

The invention relates to so-called roof curb assemblies commonly used to support air conditioning units on roofs and, more particularly, relates to a roof curb assembly having an integral heat pipe and a bypass system for permitting selective partial or complete deactivation of the heat pipe.

2. Discussion of the Related Art

Air conditioning units are mounted on roofs in a variety of applications including most commercial buildings and many other applications in which the building has a flat roof. Referring to FIG. 1, the air conditioning unit 10 typically is mounted on an enclosed frame 12, generally known in the trade as a "roof curb assembly", so as to support the air conditioning unit 10 above the maximum water level that could exist on the roof 14. The roof curb assembly 12 generally comprises a simple enclosure 16 that is placed around an opening 18 in the roof 14. Supply and return ducts 20 and 22 extend through the opening 18 to permit airflow between the roof curb assembly 12 and the air conditioning unit 10. The ducts 20 and 22 typically are located side-by-side with respect to one another with the return duct 22 directing warm air from the interior of the building and into the air conditioning unit 10 and the supply duct 20 directing cool air from the air conditioning unit 10 and into the building.

The illustrated roof curb assembly 12 is exemplary of some advanced roof curb assemblies which incorporate integral heat pipes for dehumidification purposes. Dehumidification is critical in warm, humid climates both for comfort and for mold and mildew control. At least some dehumidification takes place in the cooling coil of the typical air conditioning unit as some of the air flowing through the cooling coil is cooled to below its dewpoint. However, many air conditioning units have an inadequately low latent heat ratio for warm and humid climates. "Latent heat removal" is generally defined as the amount of moisture removed from the conditioned air and is to be distinguished from "sensible heat removal" or the amount of temperature reduction. Total heat removal consists of latent heat removal plus sensible heat removal. The latent heat ratio of an air conditioning system is that portion of latent heat that can be removed out of the total heat that can be removed. The latent heat ratio of a typical air conditioning system is around 30% at peak conditions (95° F.).

The building subject to air conditioning also has a latent heat ratio defined as that portion of latent heat that needs to be removed out of the total heat that needs to be removed for optimal cooling. At peak conditions, such as mid-afternoon on sunny days, there is much more sensible heat than latent heat, and the building's latent heat ratio is relatively low. At nights or on rainy days, the building's latent heat ratio is relatively high. During warm and humid weather, an air conditioning system that is capable of adequately cooling the building may have difficulty adequately dehumidifying the building.

It is known to use a single oversized air conditioning unit for both hot and dry hours and for cool and humid hours. However, although the air that is conditioned during cool and humid hours can be sufficiently dehumidified by such a unit, it is also uncomfortably cold. The overcooled air must then be reheated by a heater to comfortable levels. This process is extremely inefficient because energy is wasted both in the excessive operation of the air conditioning unit to overcool the air and in the subsequent heating of the overcooled air.

Passive heat exchangers known as "heat pipes" have been proposed for incorporation into air conditioning systems to increase the dehumidification capacity of the systems without employing a supplemental heater to reheat the air. As is well known to those skilled in the art, a heat pipe is a passive heat transfer system including an evaporator or cooling section or portion in contact with a warm air stream and a condenser or warming section or portion in contact with a cool air stream. Refrigerant is stored in the heat pipe and is capable of moving back and forth between the two portions. The refrigerant vaporizes in the evaporator portion as it receives heat from the warm air (thus cooling the air), flows into the condenser portion where it transfers heat to the cool air (thus warming the air) and condenses, and then flows back into the evaporator portion where the process is repeated. When used in an air conditioning system, the evaporator portion and condenser portion are positioned upstream and downstream, respectively, of the air conditioning unit's cooling coil. Air flows through the evaporator portion where it is cooled and partially dehumidified, and the cool air is then overcooled and additionally dehumidified in the air conditioning unit's cooling coil. The overcooled, dry air then is reheated to a comfortable temperature by the condenser portion of the heat pipe before flowing into the air conditioned space. A heat pipe suitable for dehumidification is disclosed in U.S. Pat. No. 4,670,498 to Dinh and assigned to Heat Pipe Technology, Inc of Alachua, Fla.

Referring again to FIG. 1, a heat pipe 26 is inserted into the adjacent supply and return ducts 20 and 22 of the roof curb assembly 12 with the condenser portion 28 located in the supply duct 20 (upstream of the air conditioning unit's cooling coil 24) and the evaporator portion 30 located in the return duct 22 (downstream of the air conditioning unit's cooling coil 24). The air conditioning system resulting from the combination of the air conditioning unit 10 and the heat pipe 26 improves the dehumidification capacity or sensible heat ratio of the air conditioning unit 10 in an efficient manner without having to depart from the basic, compact roof curb assembly design and without having to employ expensive and inefficient oversized cooling coils or the associated heaters.

It has been discovered that an air conditioning system having a roof curb assembly with an integral heat pipe, though exhibiting a dramatically improved dehumidification capacity or latent heat ratio when compared with roof top air conditioning systems lacking integral heat pipes, exhibits potential drawbacks and disadvantages. Most notably, the system's latent heat ratio is essentially fixed and it therefore is incapable of accommodating changes in the latent heat ratio of the conditioned building. That is, as discussed briefly above, optimal cooling load varies with environmental conditions. On relatively cool, humid days, it is desirable to provide the air conditioning system with a high latent heat ratio to increase dehumidification without overcooling the air. Conversely, on hot sunny days, it is desirable to decrease the latent heat ratio to maximize temperature reduction. However, since the heat pipe is always operational, it is impossible to vary the latent heat ratio of the air conditioning system with existing environmental conditions.

Moreover, when the air conditioning system is operating under high humidity conditions with added fresh air, undesirable amounts of water would tend to condense in the evaporator or cooling portion of the heat pipe and spill into the ducts of the air conditioning system with resultant detrimental effects. This problem is exasperated by the fact that, to accommodate the dimensions of the roof curb assembly, it is desirable to position the heat pipe horizontally in the curb directly within the vertical supply and return passages such that condensed water will drip directly into the underlying ducts.

One way to reduce condensation in a roof curb heat pipe is to close off the air conditioning system from fresh air so that little or no humid outside air is admitted into the system. However, this solution is inadequate because it is less effective than deactivating the heat pipe and because it is desirable in most applications to admit a significant amount of fresh air into the air conditioning system to prevent the air inside the conditioned space from becoming stale.

Another way to reduce condensation is to admit fresh air into the system at a location downstream of the cooling portion of the heat pipe. However, the fresh air does not benefit from the cooling effect of the heat pipe.

OBJECTS AND SUMMARY OF THE INVENTION

It is therefore a primary object of the invention to provide a roof curb assembly that has an integral heat pipe and that incorporates measures to selectively at least partially deactivate the heat pipe so as to permit operation of the air conditioning unit mounted on the roof curb to be optimized for existing environmental conditions, i.e., to remove more latent heat at some times than others.

Another object of the invention is to provide a roof curb assembly which meets the first object of the invention and which requires minimal if any modifications to the existing roof curb design.

Still another object of the invention is to provide a roof curb assembly which meets at least the first object of the invention and which does not significantly increase the cost of fabricating, installing, or operating the air conditioning system.

In accordance with a first aspect of the invention, these objects are achieved by providing a roof curb assembly comprising an enclosure in which is disposed a heat pipe and a bypass system. The enclosure includes 1) a supply passage extending vertically therethrough and having an upper inlet and a lower outlet, 2) a return passage extending vertically therethrough and having a lower inlet and an upper outlet, and 3) a bypass passage having an inlet in fluid communication with the inlet of one of the passages and an outlet in fluid communication with the outlet of the one passage. The heat pipe includes an evaporator portion disposed in the return passage and a condenser portion disposed in the supply passage. The bypass device selectively and alternatively 1) facilitates airflow through the one passage while inhibiting airflow through the bypass passage, and 2) inhibits airflow through the one passage while facilitating airflow through the bypass passage. The bypass device may include a bypass damper operable either alone or in conjunction with a shutoff damper or may comprise a plate slidable between the bypass passage and the one passage.

Yet another object of the invention is to provide a roof curb assembly which meets at least the first object of the invention and which permits only partial deactivation of the heat pipe so that operation of the air conditioning unit can be carefully tailored to meet prevailing dehumidification requirements.

In accordance with another aspect of the invention, this object is achieved by providing a control system for automatically controlling the bypass device to vary the percentage of airflow through the bypass passage from about 0% of the air flowing out of the outlet of the one passage to about 100% of the air flowing out of the outlet of the one passage in response to sensed temperature changes within the building.

These and other objects, features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit and scope thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a bypass system is incorporated into a roof curb assembly to permit selective partial or complete deactivation of at least one portion of a heat pipe of an air conditioning system thereby 1) to permit optimization of the sensible heat ratio of the air conditioning system for prevailing environmental conditions, and/or 2) to prevent moisture from condensing onto the evaporator or cooling portion of the heat pipe and subsequently dripping into the return ducts of the air conditioning system. The bypass system is characterized by a bypass duct located adjacent one of the portions of the heat pipe and a bypass device which selectively channels at least some of the air which would otherwise flow through the controlled portion of the heat pipe through the bypass duct instead. In its simplest form, the bypass device may comprise a single damper or the like positioned within the bypass duct. In more sophisticated systems, the bypass device may be located at least in part within the bypass duct and in part within the controlled portion of the heat pipe and may comprise, for example, a pair of interconnected dampers or a sliding plate.

2. Construction and Operation of First Embodiment

Figure 2:
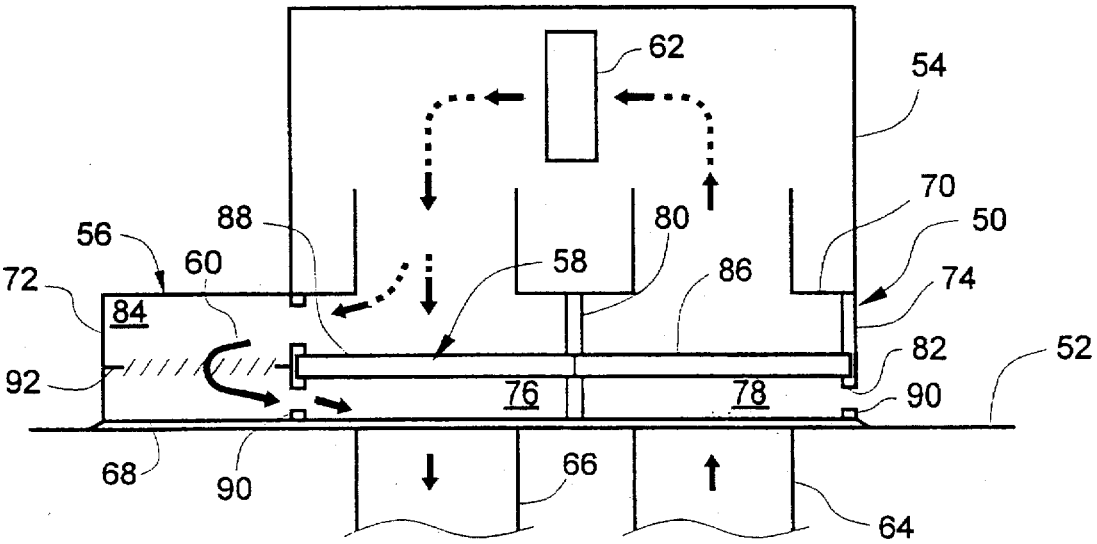
FIG. 2 is a schematic partially cut away end elevation view of a roof curb assembly constructed in accordance with a first preferred embodiment of the present invention and incorporating an integral dehumidifier heat pipe and a bypass system including a single damper.

Turning now to FIG. 2, a roof curb assembly 50 constructed in accordance with a first embodiment of the invention is mounted on a flat roof 52 and supports a conventional air conditioning unit 54. The roof curb assembly 50 includes an enclosure 56 in which is disposed a heat pipe 58 and at least part of a bypass system 60. The enclosure 56 may also may serve as a plenum for the air conditioning unit 54. As is conventional, the air conditioning unit 54 includes an evaporator coil 62, a compressor, a condenser, and an expansion valve (none of which are shown). The air conditioning unit 54 and heat pipe 58, in combination, form an air conditioning system.

The roof curb enclosure 56, apart from being modified as needed to incorporate the bypass system 60, can take any conventional configuration of a roof curb enclosure adapted to receive the heat pipe 58. The illustrated enclosure 56 includes a lower horizontal base 68 configured for resting on the roof 52, an upper horizontal support surface 70 configured for supporting the air conditioning unit 54, and a plurality of sidewalls extending vertically from the base 68 to the support surface 70. The typical enclosure 56 is rectangular in shape and hence includes a left sidewall 72, a right sidewall 74, and front and rear sidewalls (not shown). A supply passage 76 extends vertically from the base 68 to the support surface 70 and has an upper inlet configured for fluid communication with the interior of the air conditioning unit 54 and a lower outlet configured for fluid communication with the supply duct 66. A return passage 78 is located adjacent the supply passage 76, extends vertically from the base 68 to the support surface 70, and has a lower inlet configured for fluid communication with the return duct 64 and an upper outlet configured for fluid communication with the interior of the air conditioning unit 54. The supply and return passages 76 and 78 are separated by a partition 80 which extends vertically from the base 68 to the support surface 70. A fresh air supply passage 82 extends through sidewall 74 so as to have an inlet opening to the ambient atmosphere and an outlet opening into the return passage 78. If desirable, this fresh air supply passage 82 can be selectively closed by suitable operation of a damper (not shown).

A bypass passage 84 is also disposed in the roof curb enclosure 56 to permit air to selectively bypass at least one portion of the heat pipe 58. In the illustrated and preferred embodiment, the bypass passage 84 is located horizontally adjacent the supply passage 76 so as to have an inlet opening into the inlet of the supply passage 76 and an outlet opening into the outlet of the supply passage 76. It should be understood, however, that the bypass passage 84 could be supplemented or replaced by a bypass passage located adjacent the return passage 78.

The heat pipe 58 may comprise any passive heat exchange system of the type used in roof curb assemblies for dehumidification purposes. The preferred and illustrated heat pipe 58 is relatively thin and rectangular in shape so as to be well-suited for horizontal mounting in the roof curb enclosure 56. The heat pipe 58 includes an evaporator or cooling section or portion 86 disposed in the return passage 78 and a condenser or reheating section or portion 88 disposed in the supply passage 76. Both portions 86 and 88 are mounted on internal supports 90 of the enclosure 56 so as to be positioned in a generally central vertical location within the respective return and supply passages 76 and 78. As is standard, the evaporator and condenser portions 86 and 88 are connected to one another by suitable supply and return tubes (not shown) extending through the partition 80. The supports 90 and the partition 80 preferably are slotted so that the heat pipe 58 can be easily slid into and out of location for cleaning or maintenance purposes.

Figure 1:
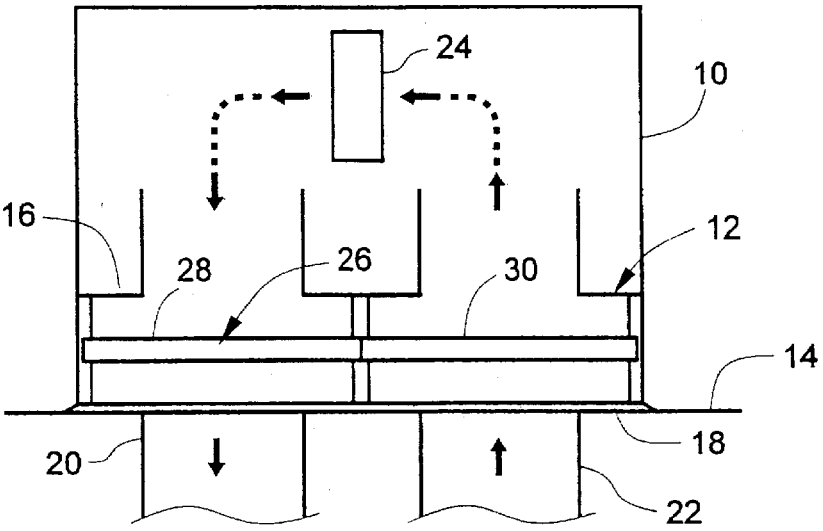
Fig. 1 PRIOR ART
FIG. 1 is a schematic partially cut away end elevation view of a prior art roof curb assembly and integral dehumidifier heat pipe, appropriately labeled "PRIOR ART"

The bypass system 60 includes the bypass passage 84 and a bypass device. The bypass device is operable to selectively and alternatively 1) facilitate airflow through the supply passage 76 and the condenser portion 88 of the heat pipe 58, thereby permitting the heat pipe 58 to operate normally and 2) inhibit or even prevent airflow through the supply passage 76 and condenser portion 88 of the heat pipe 58, thereby partially or completely deactivating the heat pipe 58. In the embodiment of FIG. 1, the bypass device comprises a conventional damper 92 extending horizontally across the bypass passage 84 from the wall 72 to the support 90. The damper 92 may be controlled either electrically by a motor or manually and, if electrically controlled, may be controlled automatically as discussed in more detail in Section 3 below in conjunction with the second embodiment.

The operation of the air conditioning system including the air conditioning unit 54, the heat pipe 58, and the bypass system 60 will now be detailed.

First, assuming that the air conditioning unit 54 is being operated under conditions in which maximum dehumidification is desired, the damper 92 will be closed either manually or electrically to close the bypass passage 84. All air flowing through the air conditioning unit 54 therefore must flow through the condenser portion 88, and the heat pipe 58 functions normally to maximize dehumidification or latent heat removal. Hence, warm humid air at a temperature of, e.g., 80° F. flows from the return duct 64 and the fresh air supply passage 82 and into the evaporator or cooling portion 86, where it is cooled to approximately 75° F. and partially dehumidified. The partially-cooled and partially dehumidified air is then overcooled in the evaporator coil 62 of the air conditioning unit 54 to approximately 55° F. for maximum dehumidification potential. The overcooled air is then reheated in the condenser portion 88 of the heat pipe 58 to a more comfortable temperature of about 60° F. before flowing back into the conditioned space through the supply duct 66.

Assuming now that it is desired to deactivate the heat pipe 58, either because the air conditioning system is being operated under conditions in which there is a danger of excessive condensation in the evaporator portion 86 and/or the system is being operated under very hot conditions in which maximum sensible heat removal is desired, the heat pipe 58 is deactivated by opening the damper 92 as illustrated in FIG. 2. Because the coils of the heat pipe 58 provide significant resistance to airflow, the majority of the air flowing into the supply passage 76 from the air conditioning unit 54 follows the path of least resistance through the bypass passage 84 and around the condenser portion 88 rather than through the condenser portion 88. As a result, little or no heat is transferred from the vaporized refrigerant in the condenser portion 88, and the refrigerant does not condense. Hence, no liquid refrigerant is available in the evaporator portion 86 for vaporization, and the heat pipe 58 is deactivated. Air flowing through the system therefore is cooled only by the air conditioning unit's cooling coil 62 as if the heat pipe 58 did not exist. As a result, condensation problems in the evaporator portion 86 are eliminated, the air conditioning system's sensible heat ratio is maximized, and the fresh air inlet passage 82 can remain open.

As discussed briefly above, many other bypass devices can be used to deactivate the heat pipe 58 so long as the net result is that at least a significant percentage of air flowing through the air conditioning system bypasses one or more portions of the heat pipe so that the heat pipe is partially or completely deactivated. Two alternative bypass devices will now be described, both of which are somewhat more sophisticated in design than the single damper device illustrated in FIG. 2.

3. Construction and Operation of Second Embodiment

Figure 3:
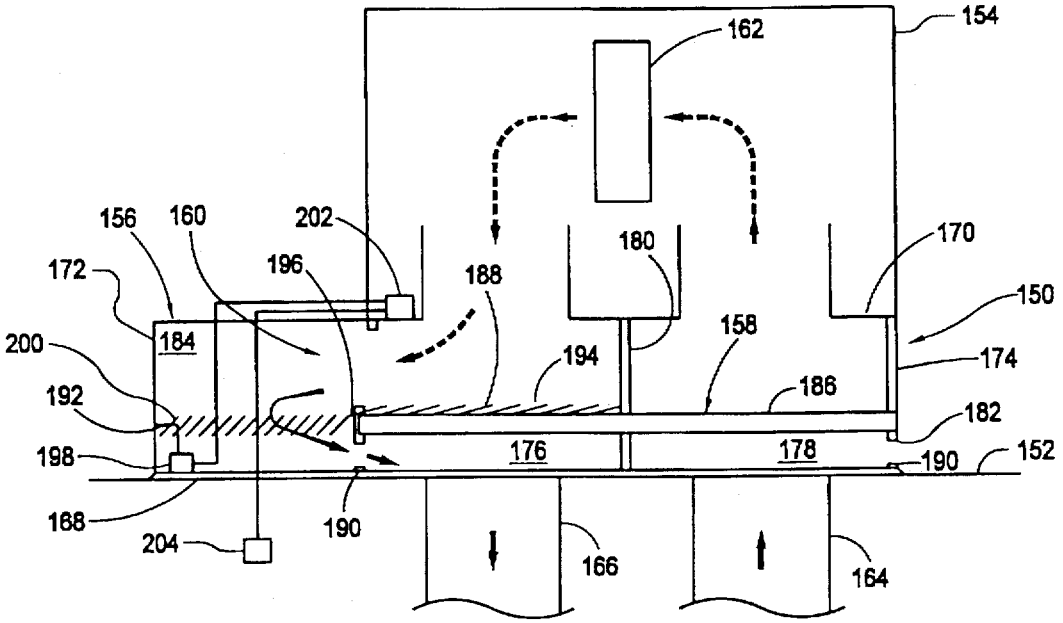
FIG. 3 is a schematic partially cut away end elevation view of a roof curb assembly and integral dehumidifier heat pipe constructed in accordance with a second preferred embodiment of the present invention and incorporating a bypass system including a bypass damper and a shut off damper.

Turning now to FIG. 3, a roof curb assembly 150 constructed in accordance with a second embodiment of the invention is illustrated that differs from the roof curb assembly 50 of the first embodiment only in that it incorporates a more sophisticated damper arrangement as its bypass device. Components of the second embodiment that are identical to those first embodiment are designated by the same reference numerals, incremented by one hundred and, for the sake of conciseness, will not be detailed. The roof curb assembly 150 therefore includes an enclosure 160 having a base 168 configured for resting on the roof 152, a support surface 170 configured for supporting the air conditioning unit 154, and vertical members 172, 174, and 180 defining a supply passage 176, a return passage 178, and a bypass passage 184.

The bypass device of this embodiment differs from the single damper arrangement bypass device of the first embodiment to the extent that it is capable of controlling more precisely airflow through the supply passage 176 because it incorporates a second, shutoff damper 194 in the supply passage 176 that is linked to the first, bypass damper 192. In the illustrated embodiment, the second damper 194 is linked to the first damper 192 by a mechanical linkage 196 that causes the second damper 194 to open to a degree that is inversely proportional to the opening degree of the first damper 192. Hence, when the first damper 192 is fully closed, the second damper 194 is fully open, and vice versa. Linkage 196 may comprise any well known linkage capable of causing dampers to operate in conjunction with one another in this manner.

The dual damper configuration of this embodiment is better-suited for more precisely partially-deactivating the heat pipe 158 than is the single damper configuration of the first embodiment. This configuration therefore is well suited for use with an automatic control system that is responsive to changing environmental conditions such as temperature variations. Hence, damper position is controlled automatically by an electric motor 198 linked to the dampers 192 and 194 by a conventional drive rod 200. Motor 198 is controlled by a controller 202 in response, e.g., to variations in the temperature within the building being conditioned as determined by a suitable temperature sensor 204. The controller 202 is configured to automatically control the motor 198 to alter the positions of the first and second dampers 192 and 194 to vary the percentage of airflow through the bypass passage 184 from about 0% under relatively cool conditions (e.g., when the temperature as determined by sensor 204 is 75° F. or less) to about 100% under relatively hot conditions (e.g., when the temperature monitored by the sensor 204 is 90° F. or more). In an even more sophisticated embodiment, the controller 202 also could receive signals from a humidity sensor and combine these signals with those from the temperature sensor 204.

4. Construction and Operation of Third Embodiment

Figure 4:
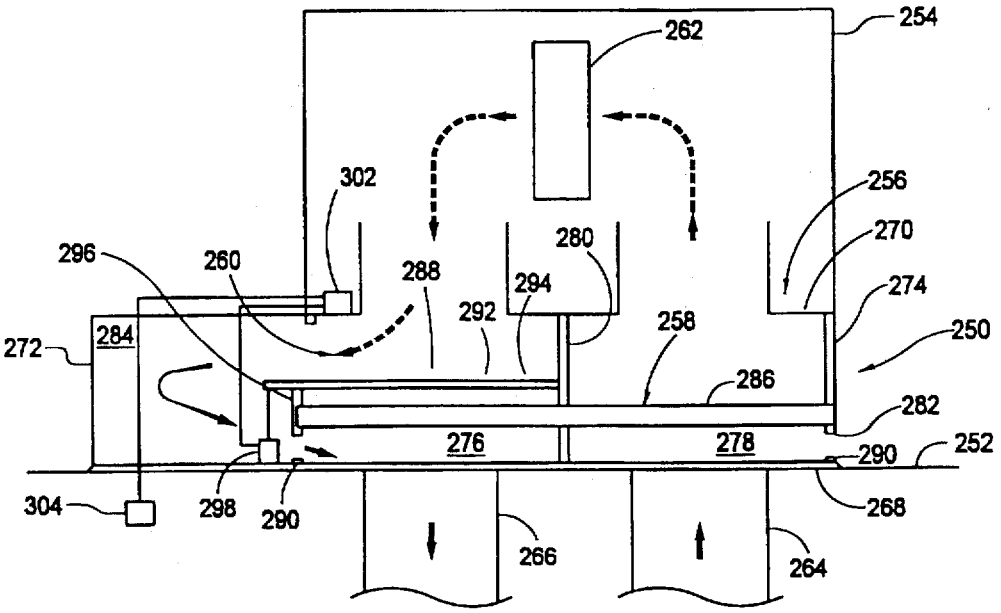
FIG. 4 is a schematic partially cut away end elevation view of a roof curb assembly constructed in accordance with a third embodiment of the invention and incorporating an integral dehumidifier heat pipe and a bypass system including a horizontally movable plate.

Turning now to FIG. 4, a third embodiment of the invention is illustrated which is functionally similar to but structurally different from the second embodiment. That is, like the second embodiment, it is capable of relatively precisely partially deactivating the heat pipe. However, this deactivation is effected via a single sliding plate 292 rather than by a pair of inversely operating dampers.

The plate 292 is mounted above the condenser portion 288 of the heat pipe 258 and is movable horizontally between 1) a first position in which it completely blocks the bypass passage 284 and leaves the supply passage 276 open, thereby preventing airflow through the bypass passage 284 while permitting substantially uninhibited airflow through the supply passage 276 and 2) a second position in which it leaves the bypass passage 284 open and closes the supply passage 276, thereby preventing airflow through the supply passage 276 and permitting substantially uninhibited airflow through the bypass passage 284. The plate 292 is slidably supported in grooves of opposed support rails or on any other suitable support surface (not shown) extending horizontally across the supply and bypass passage 276 and 284. A rack 294 is mounted on one side of the plate 292 and meshes with a pinion 296.

An electric motor 298 drives the pinion 296 to move the rack 294 and hence the plate 292 between its first and second positions. The motor 298, like the motor of the second embodiment, is operated by a controller 302 which receives signals from a temperature sensor 304 located within the building. The controller 302 is operable to control the motor 298 to alter the position of the plate 292 and to vary the percentage of airflow through the bypass passage 284 between 0% to 100% and virtually any percentage in between, thereby optimizing the percentage of bypass airflow for prevailing environmental conditions.

The construction and operation of the air conditioning system including the roof curb assembly 250 and the air conditioning unit 254 of the third embodiment is otherwise identical to that of the second embodiment, and its components therefore are designated by the same reference numerals as those of the second embodiment, incremented by 100.

Many changes and alterations could be made to the invention without departing from the spirit thereof. The scope of some of these changes are discussed above. The scope of the remaining changes will become apparent from the appended claims.

I claim:

1. A roof curb assembly comprising:

(A) an enclosure configured for mounting on a roof of a building and for supporting an air conditioning unit, said enclosure including (1) a supply passage extending vertically therethrough and having an upper inlet and a lower outlet, (2) a return passage extending vertically therethrough and having a lower inlet and an upper outlet, and (3) a bypass passage having an inlet in fluid communication with the inlet of one of said supply and return passages and an outlet in fluid communication with the outlet of said one passage;

(B) a heat pipe disposed in said enclosure curb, said heat pipe including an evaporator portion disposed in said return passage and a condenser portion disposed in said supply passage; and (C) bypass means for selectively and alternatively (1) facilitating airflow through said one passage while inhibiting airflow through said bypass passage, and (2) inhibiting airflow through said one passage while facilitating airflow through said bypass passage.

2. A roof curb assembly as defined in claim 1, wherein said bypass means comprises a damper disposed in said bypass passage, said damper being movable between (a) a closed position inhibiting airflow through said bypass passage, and (b) an open position permitting essentially uninhibited airflow through said bypass passage.

3. A roof curb assembly as defined in claim 2, wherein said damper comprises a first damper, and wherein said bypass means further comprises a second damper located in said one passage, said second damper being movable between (a) an open position permitting essentially uninhibited airflow through said one passage, and (b) a closed position inhibiting airflow through said one passage.

4. A roof curb assembly as defined in claim 3, further comprising means for operationally tying said first and second dampers to one another such that said first and second dampers move inversely with respect to one another so that said first damper is closed when said second damper is open and said first damper is open when said second damper is closed.

5. A roof curb assembly as defined in claim 4, wherein said means for operationally tying comprises a mechanical linkage connected to said first damper and to said second damper.

6. A roof curb assembly as defined in claim 1, wherein said bypass passage is located adjacent to and at least partially in a common vertical plane with said one passage, and wherein said bypass means comprises a plate which is movable horizontally between (a) a first position in which said plate closes said bypass passage and leaves said one passage open, and (b) a second position in which said plate leaves said bypass passage open and closes said one passage.

7. A roof curb assembly as defined in claim 6, further comprising a rack which is mounted on said plate, a pinion which meshes with said rack, and a drive motor which drives said pinion to move said rack and said plate between said first and second positions.

8. A roof curb assembly as defined in claim 1, further comprising control means for automatically controlling said bypass means to vary the percentage of airflow through said bypass passage from about 0% of the air flowing out of said outlet of said one passage to about 100% of the air flowing out of said outlet of said one passage in response to sensed temperature changes within the building.

9. A roof curb assembly comprising:

(A) an enclosure including (1) a lower horizontal base configured for resting on a roof of a building, (2) an upper horizontal support surface configured for supporting an air conditioning unit, (3) a plurality of sidewalls extending vertically from said base to said support surface, (4) a supply passage extending vertically from said base to said support surface and having an upper inlet configured for fluid communication with the air conditioning unit and a lower outlet configured for fluid communication with a supply duct in the roof, (5) a return passage extending vertically from said base to said support surface and having a lower inlet configured for fluid communication with a return duct in the roof and an upper outlet configured for fluid communication with the air conditioning unit, (6) a partition extending vertically from said base to said support surface to separate said supply passage from said return passage, (7) a fresh air supply passage extending through one of said sidewalls, said fresh air supply passage having an inlet opening to the ambient atmosphere and an outlet opening into said return passage, and (8) a bypass passage extending from the inlet of said supply passage to the outlet of said supply passage;

(B) a heat pipe disposed in said enclosure, said heat pipe including (1) an evaporator portion disposed in said return passage at a location above said outlet of said fresh air supply passage, (2) a condenser portion disposed in said supply passage and located in the same horizontal plane as said evaporator portion, and (3) tubes extending through said partition and connecting said evaporator portion to said condenser portion; and (C) a damper which is located in said bypass passage and which extends horizontally across said bypass passage, at least a portion of said damper being movable between (1) a closed position substantially preventing airflow through said bypass passage, and (2) an open position permitting essentially uninhibited airflow through said bypass passage.

10. A roof curb assembly as defined in claim 9, wherein said damper comprises a first damper, and further comprising a second damper which extends horizontally across said supply passage at a location vertically between said inlet of said supply passage and said condenser portion of said heat pipe, said second damper being movable between (a) an open position permitting essentially uninhibited airflow through said supply passage, and (b) a closed position substantially preventing airflow through said supply passage; and a mechanical linkage connected to said first damper and to said second damper, said mechanical linkage operationally tying said first and second dampers to one another such that said first and second dampers move inversely with respect to one another so that said first damper is closed when said second damper is open and said first damper is open when said second damper is closed.

11. A roof curb assembly as defined in claim 10, further comprising a motor which is coupled to said mechanical linkage and which is operable to drive said mechanical linkage to open and close said first and second dampers.

12. A roof curb assembly as defined in claim 11, further comprising a control device which is coupled to said motor and which is configured to automatically control said motor to alter the positions of said first and second dampers to vary the percentage of airflow through said bypass passage from about 0% of the air flowing out of said outlet of said supply passage to about 100% of the air flowing out of said outlet of said supply passage in response to sensed temperature changes within the building.

13. A roof curb assembly comprising:

(A) an enclosure including (1) a lower horizontal base configured for resting on a roof of a building, (2) an upper horizontal support surface configured for supporting an air conditioning unit, (3) a plurality of sidewalls extending vertically from said base to said support surface, (4) a supply passage extending vertically from said base to said support surface and having an upper inlet configured for fluid communication with the air conditioning unit and a lower outlet configured for fluid communication with a supply duct in the roof, (5) a return passage extending vertically from said base to said support surface and having a lower inlet configured for fluid communication with a return duct in the roof and an upper outlet configured for fluid communication with the air conditioning unit, (6) a partition extending vertically from said base to said support surface to separate said supply passage from said return passage, (7) a fresh air supply passage extending through one of said sidewalls, said fresh air supply passage having an inlet opening to the ambient atmosphere and an outlet in opening into said return passage, and (8) a bypass passage extending from the inlet of said supply passage to the outlet of said supply passage;

(B) a heat pipe disposed in said enclosure curb, said heat pipe including (1) an evaporator portion disposed in said return passage at a location above said outlet of said fresh air supply passage, (2) a condenser portion disposed in said supply passage and located in the same horizontal plane as said evaporator portion, and (3) tubes extending through said partition and connecting said evaporator portion to said condenser portion; and (C) a plate which is located above said condenser portion of said heat pipe and which is movable horizontally between (1) a first position in which said plate blocks said bypass passage to close said bypass passage and to leave said supply passage open, thereby substantially preventing airflow through said bypass passage while permitting substantially uninhibited airflow though said supply passage, and (2) a second position in which said plate leaves said bypass passage open and closes said supply passage, thereby substantially preventing airflow through said supply passage while permitting substantially uninhibited airflow though said bypass passage.

14. A roof curb assembly as defined in claim 13, further comprising a rack which is mounted on said plate, a pinion which meshes with said rack, and a drive motor which drives said pinion to move said rack and said plate between said first and second positions.

15. A roof curb assembly as defined in claim 14, further comprising a control device which is coupled to said motor and which is configured to automatically control said motor to alter the position of said plate to vary the percentage of airflow through said bypass passage from about 0% of the air flowing out of said outlet of said supply passage to about 100% of the air flowing out of said outlet of said supply passage in response to sensed temperature changes within the building.

* * * * *